US011486160B2

(12) United States Patent
Progar et al.

(10) Patent No.: US 11,486,160 B2
(45) Date of Patent: Nov. 1, 2022

(54) SECURING DEVICE FOR LARGE SCALE COVER SYSTEMS

(71) Applicants: Edmond Lloyd Progar, Pinckney, MI (US); Wally Vendramini, Livonia, MI (US); John Anthony Progar, Rice, WA (US)

(72) Inventors: Edmond Lloyd Progar, Pinckney, MI (US); Wally Vendramini, Livonia, MI (US); John Anthony Progar, Rice, WA (US)

(73) Assignee: Meadowlark Enterprise, LLC, Pinckney, MI (US)

( * ) Notice: Subject to any disclaimer, the term of this patent is extended or adjusted under 35 U.S.C. 154(b) by 85 days.

(21) Appl. No.: 16/524,658

(22) Filed: Jul. 29, 2019

(65) Prior Publication Data

US 2020/0032543 A1 Jan. 30, 2020

Related U.S. Application Data

(60) Provisional application No. 62/703,978, filed on Jul. 27, 2018.

(51) Int. Cl.
*E04H 15/32* (2006.01)

(52) U.S. Cl.
CPC ..... *E04H 15/32* (2013.01)

(58) Field of Classification Search
USPC ..... 248/500, 506, 910; 249/117, 134; 215/396, 398, 383, 384, 382; 220/770
See application file for complete search history.

(56) References Cited

U.S. PATENT DOCUMENTS

| | | | | |
|---|---|---|---|---|
| 5,000,405 | A * | 3/1991 | Rybak | A62C 33/04 248/910 |
| 7,731,133 | B2 * | 6/2010 | Kochanski | B60R 15/00 248/79 |
| 9,234,732 | B1 * | 1/2016 | Cummings, III | F42B 39/14 |
| 2013/0213846 | A1 * | 8/2013 | Hendrickson | B65D 21/0231 206/509 |

* cited by examiner

*Primary Examiner* — Alfred J Wujciak
(74) *Attorney, Agent, or Firm* — The Dobrusin Law Firm, PC

(57) ABSTRACT

A securing system for a covering device comprising a polymeric shell including a receptacle portion and an optional cover portion, the receptacle portion being formed of a base portion and one or more walls and at least one opening formed within the shell, wherein the opening is adapted to receive a material capable of flowing and optionally curing to form a filled receptacle portion, the filled receptacle portion forming a solid weight for use in securing a covering the covering device.

19 Claims, 6 Drawing Sheets

SECURING DEVICE FOR LARGE SCALE COVER SYSTEMS

FIELD OF THE INVENTION

The present teachings relate generally to securing systems for maintaining large, flexible covers in a desired location. More specifically, the teachings relate to devices for receiving flowable materials that form solid weights for securing covering systems.

BACKGROUND OF THE INVENTION

It is common that dirt, rocks, or other heavy objects such as bricks or pavers are utilized for securing tarps and other large cover fabrics, especially for crop cover materials. Alternatively, burlap or polymer (e.g., Nylon) sacks filled with sand or pebbles may be utilized. There are a variety of issues that arise by using these types of materials. These sacks are not environmentally sound, as they frequently degrade and leave plastic debris or pebbles in the field when they degrade. Further, the material for forming the sacks cannot withstand environmental conditions, requiring frequent replacement, often failing to last a single growing season. As an additional issue, it takes significant time to fill the sacks with sand, pebbles or other items.

Accordingly, it would be beneficial to have a securing device that is environmentally friendly, easily produced, and can withstand significant environmental stress over time without degrading.

SUMMARY OF THE INVENTION

The present teachings meet one or more of the above needs by the improved devices described herein.

In one aspect, the present teachings provide for a securing system for a covering device comprising a polymeric shell including a receptacle portion and an optional cover portion, the receptacle portion being formed of a base portion and one or more walls, and at least one opening formed within the shell, wherein the opening is adapted to receive a material capable of flowing and optionally curing to form a filled receptacle portion, the filled receptacle portion forming a solid weight for use in securing a covering the covering device. A covering device is defined herein as any flexible material (which may be a woven material or non-woven material) including but limited to a fabric, a tarp, a crop cover, a sheet, or the like and any of these terms may be utilized interchangeably herein.

The receptacle portion may include at least one end wall and at least one side wall. The at least one opening may be located in the at least one end wall. The material capable of flowing may cure and solidify over time to form the solid weight. The polymeric shell may be cut and removed from the solid weight. The solid weight may be used to secure a covering device while the polymeric shell surrounds the solid weight or once the polymeric shell is removed from the solid weight. The polymeric shell may comprise a material that may or may not be substantially UV resistant. The solid weight may be formed by concrete, sand, pebbles, stones, or rocks. The cover portion may be a cap that engages the receptacle portion in a snap-fit or screw mechanism.

The covering device is a tarp. The system may include a pourable concrete for locating into the opening in a flowable state. The polymeric shell may include one or more indentations. The polymeric shell may comprise a thermoplastic material. The polymeric shell may be formed from one or any combination of polyethylene, high density polyethylene (HDPE), low density polyethylene (LDPE), polyamide, polyethylene terephthalate (PET), biaxially-oriented polyethylene terephthalate (BoPET), polypropylene, polystyrene, polyvinyl chloride, polyurethane, silicone, or synthetic rubber. The polymeric shell may be formed from one or any combination of wood, hemp, or natural rubber. The polymeric shell may be recyclable. The polymeric shell may be re-usable.

The receptacle portion may include an internal surface and an external surface. The internal surface and/or external surface may include one or more rib structures. The internal surface may be substantially smooth to produce a solid weight having a smooth surface.

The teachings herein further envision a method for forming a securing system for covering devices comprising: forming a polymeric shell including a receptacle portion having a base portion and at least one wall; locating a substantially flowable material optionally capable of cure into the opening to form a solid weight; and optionally cutting the receptacle portion from the solid weight.

DETAILED DESCRIPTION

Figure 1B:
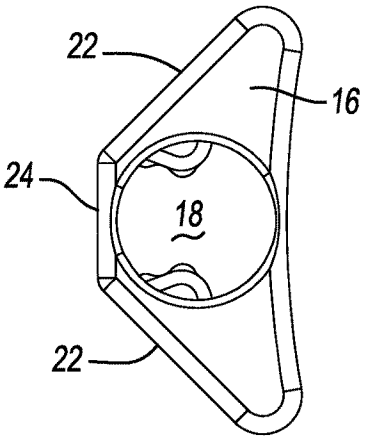
FIG. 1B is a side view of the shell of FIG. 1A.
Figure 1D:
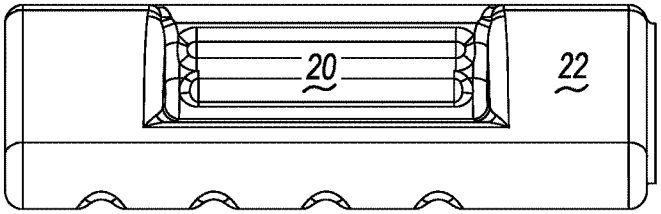
FIG. 1D is a profile view of the shell of FIG. 1A.
Figure 1E:
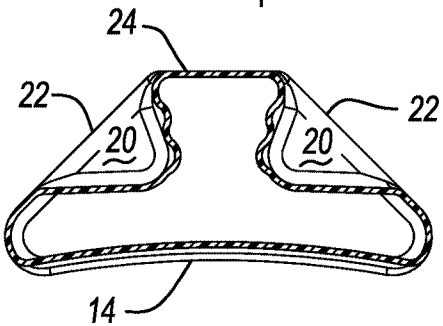
FIG. 1E is a cross-section view of the shell of FIG. 1A taken along the line shown in FIG. 1D.
Figure 1A:
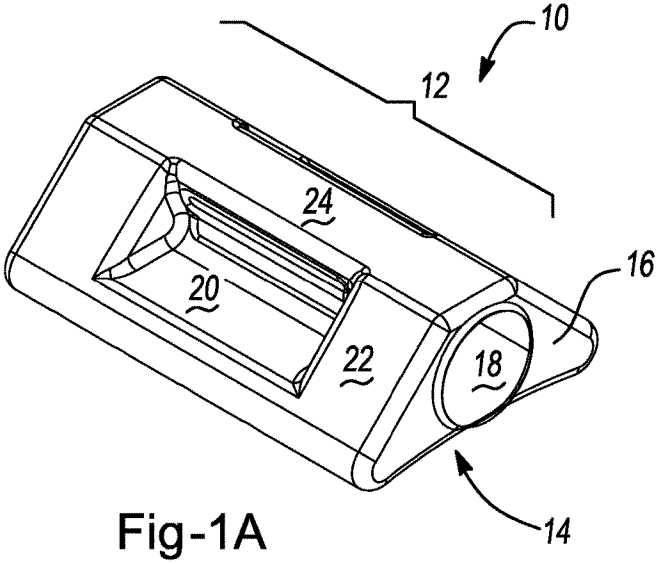
FIG. 1A is a perspective view of an illustrative shell in accordance with the present teachings.
Figure 1C:
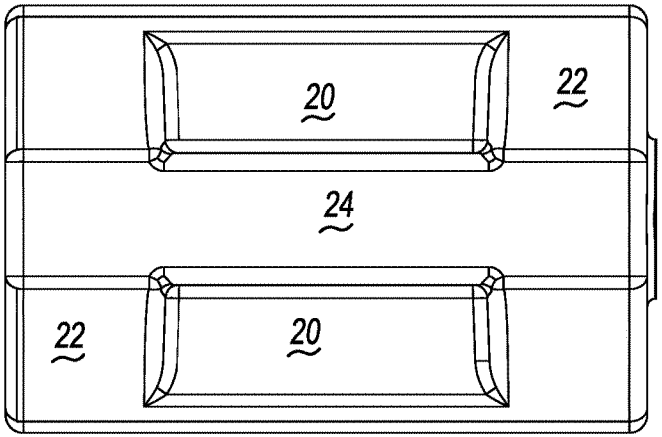
FIG. 1C is a top-down view of the shell of FIG. 1A.

The present teachings meet one or more of the above needs by the improved devices and methods described herein. The explanations and illustrations presented herein are intended to acquaint others skilled in the art with the teachings, its principles, and its practical application. Those skilled in the art may adapt and apply the teachings in its numerous forms, as may be best suited to the requirements of a particular use. Accordingly, the specific embodiments of the present teachings as set forth are not intended as being exhaustive or limiting of the teachings. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

This application claims the benefit of the filing date of U.S. Provisional Application Ser. No. 62/703,978, filed on Jul. 27, 2018, the contents of this application being hereby incorporated by reference for all purposes.

The teachings herein contemplate a unique approach for providing securing structures for large tarps or other covering systems. Typically, crop cover fabrics are used in planting operations to cover crops and/or gardens in an effort to protect the plants from environmental damage and damage from insects and animals. Such tarp structures may also be utilized to cover and protect mechanical equipment from environmental damage.

The system described herein includes use of a shell structure including a receptacle portion that receives a flowable material. The flowable material may cure and harden, or the flowable material may remain flowable, requiring a cover portion or cap to maintain the flowable material within the receptacle portion. The receptacle portion may be formed of a single piece as a unitary construction. The receptacle portion may be formed as a multi-piece construction. The shell may be formed to include an opening for receiving the flowable material. The resulting weight of the shell after filling and/or after cure, should be at least 5 pounds, at least 7 pounds, at least 10 pounds, at least 12 pounds, or even at least about 15 pounds or more.

The shell may include one or more walls. The shell may extend along a longitudinal axis. The shell may include a base portion that may be convex and may be formed along the bottom of the receptacle portion. The shell may be formed of one wall, two walls, three walls or four walls, or five walls. The shell may include two end walls that extend substantially perpendicular to the base wall. The end walls may also be formed substantially perpendicular to the longitudinal axis. The shell may include at least two side walls. The side walls may extend the full length of the shell. The side walls may extend at an angle that is skew relative to the base portion. The side walls may extend substantially perpendicular to the base portion. The side walls may extend to meet one another. Alternatively, the side walls may extend upward to contact a top wall that lies substantially parallel to the base portion.

The opening may be formed in any of the aforementioned walls. The opening may be formed in an end wall. The opening may have any shape. The opening may be substantially circular or substantially ovoid in shape. The opening may be rectangular in shape. The opening may be formed to receive a cover portion (e.g., a cap). The opening may include a beveled edge or the edge may be substantially flush with the wall in which the opening resides. The opening may be threaded to receive a screw cap.

The shell may be formed to have one or more indent portions, such that a portion of one or more of the walls is non-planar. The indent portions may be formed by a curved wall portion or a substantially angled wall portion. The indent may be formed by a 90° angle. The indent may be formed at an obtuse angle or acute angle. The indent may include one or more rib structures.

The shell may include an internal surface and an external surface. One or more of the internal surface and external surface of the receptacle portion may include one or more ribs formed in the shell material. The internal surface of the shell may be substantially smooth so that a resulting cured flowable material has a smooth surface.

The material located into the shell may be one that is capable of flowing. The material may cure and solidify over time forming a solid weight. The shell may then be removed from the solid weight. The solid weight may be used to secure a covering device (e.g., a flexible device such as a tarp or crop cover fabric) while the shell surrounds the solid weight. Alternatively, once the shell is removed from the solid weight, the solid weight may be utilized without the shell, and the shell can be recycled.

The shell may comprise a material that is substantially UV resistant. The shell may comprise a material that is recyclable. The shell may be formed of a material so that it can be re-used to receive other flowable materials. The shell may comprise a thermoplastic material. The shell may be formed from one or any combination of polyethylene, high density polyethylene (HDPE), low density polyethylene (LDPE), polyamide, polyethylene terephthalate (PET), biaxially-oriented polyethylene terephthalate (BoPET), polypropylene, polystyrene, polyvinyl chloride, silicone or synthetic rubber. The shell may be formed from one or any combination of wood, hemp, or natural rubber.

The flowable material may be one that cures and solidifies over time, such as concrete. Alternatively, the flowable material may be one that remains flowable such as sand, pebbles, rocks or the like. It is possible that the flowable material is a liquid material such as water. The resulting solid weight may thus comprise a cured concrete material with the shell removed or still on. The resulting solid weight may comprise the shell filled with a flowable material.

The resulting solid weights, or combined solid weight and shell may be utilized to hold a covering system in place, particular covering plants. The covering system may be any flexible material such a tarp, row cover fabric, blanket, plastic sheath, or any other material that may be utilized as a protective measure and requires securing to a ground surface. As an added benefit, the solid weights and shells described herein are capable of securing a covering without being driven into the substrate. Thus, there are no challenges relating to hard or soft substrates or extra installation steps such as those associated with stakes and the like.

The shell may include an opening and the opening may receive a flowable material, which may be a flowable material that remains flowable or may be a material that cures and solidifies over time to form the solid weight. In the event that the material cures and solidifies, the shell portions may be removed from the solid weight and the shell portions and recycled. Shells that are filled with flowable materials that do not cure, can be emptied and re-used. It is possible that the shells may be shaped to allow for simplified stacking in storage.

The resulting solid weights, or shells containing solid or flowable material may then be utilized to secure a covering system in place. The solid weights and/or shells are capable of withstanding significant environmental damage from UV light, moisture, heat, cold, rain, ice and the like. They are also resistant to damage from insects, birds and other animals.

The shell may be formed by an injection molding process. The shell may be formed by an extrusion process or a pultrusion process. The shell may be blow molded.

Figure 2:
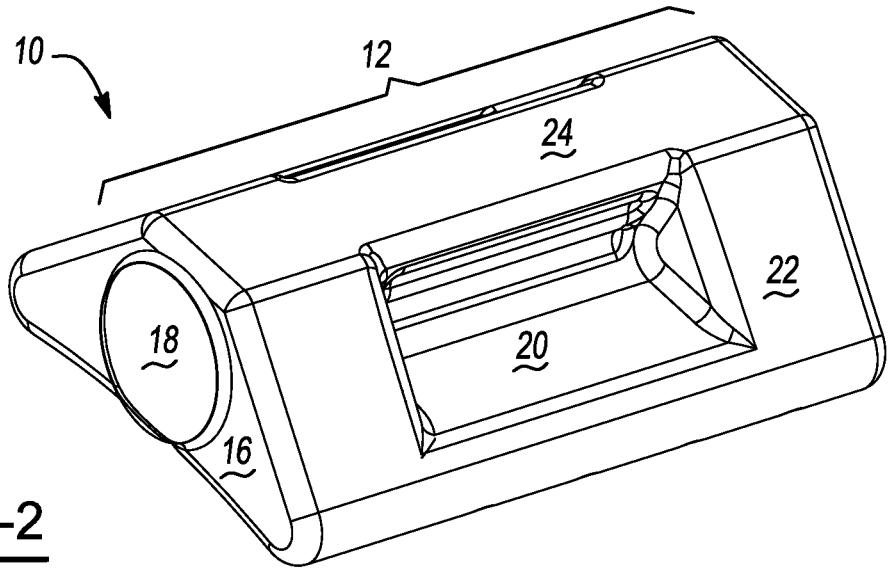
FIG. 2 is a perspective view of the shell of FIG. 1.

As shown for example in FIGS. 1 and 2, the shell 10 includes a receptacle portion 12 having a base portion 14 and two end walls 16. An opening 18 is formed in one of the end walls 16. The opening 18 is adapted to receive a flowable material (not shown). The shell may include an indent 20, which may facilitate transport and/or storage of the shell. The shell 10 is shown with two side walls 22 which intersect a top wall 24 that is arranged parallel to the base portion 14.

Figure 3:
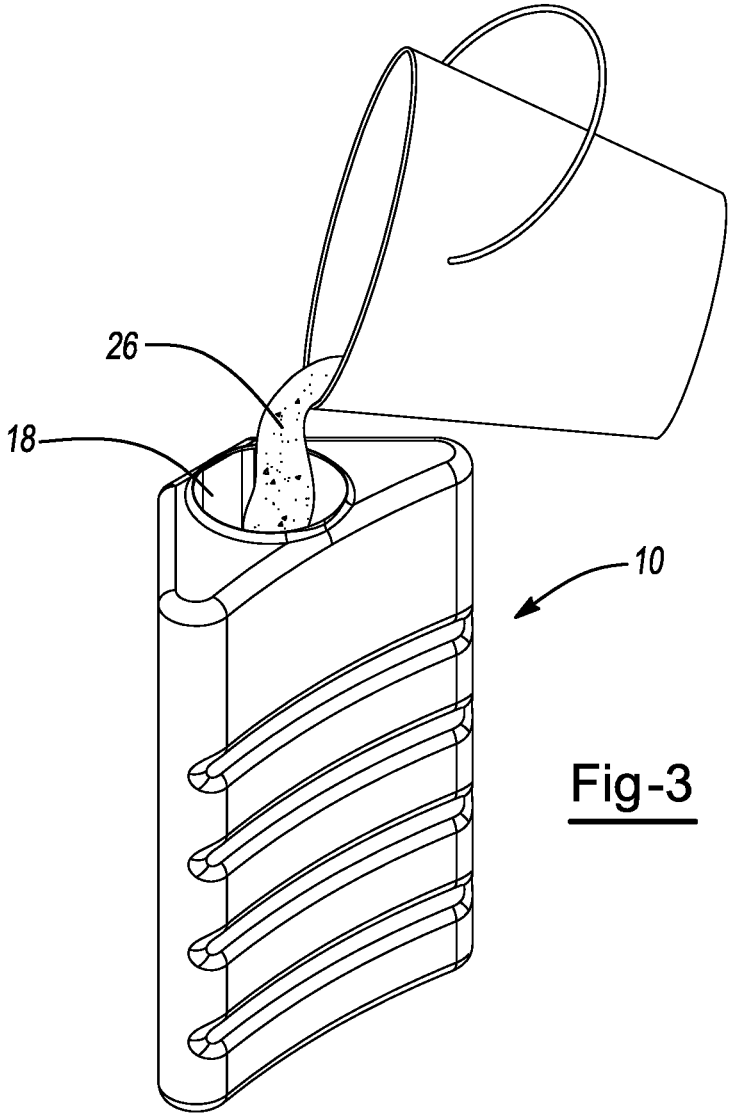
FIG. 3 is a perspective view of the plastic shell of FIG. 2 filling with concrete.

As shown for example in FIG. 3, the shell 10 is shown filled with a concrete material 26. The opening 18 is visible as having received the concrete material 26.

Figure 4:
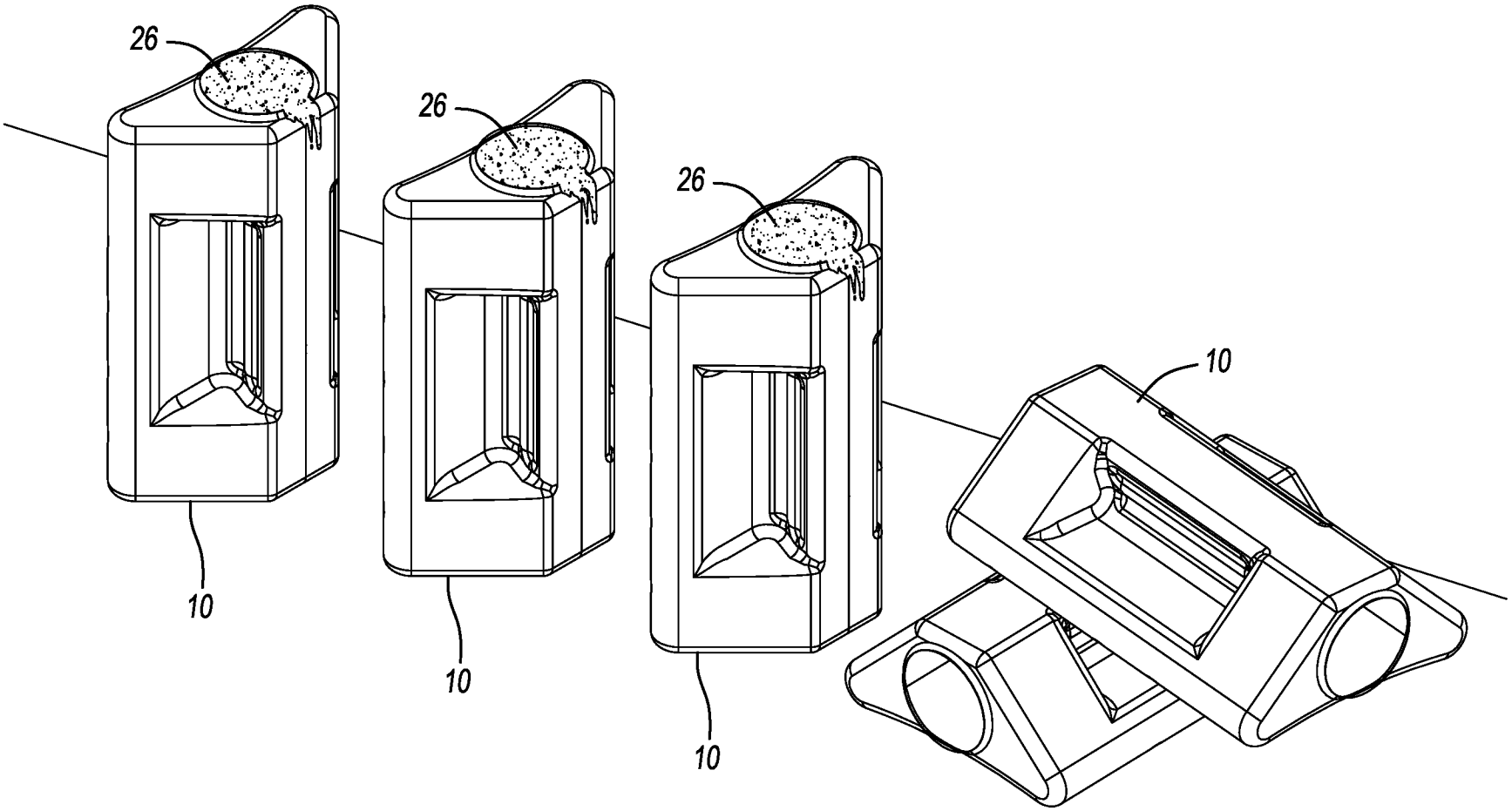
FIG. 4 is a perspective view of a plurality of filled plastic shells as shown in FIG. 3

As shown for example in FIG. 4, a plurality of shells 10 are filled with the concrete material 26 in series.

Figures 5A, 5B, 5C:
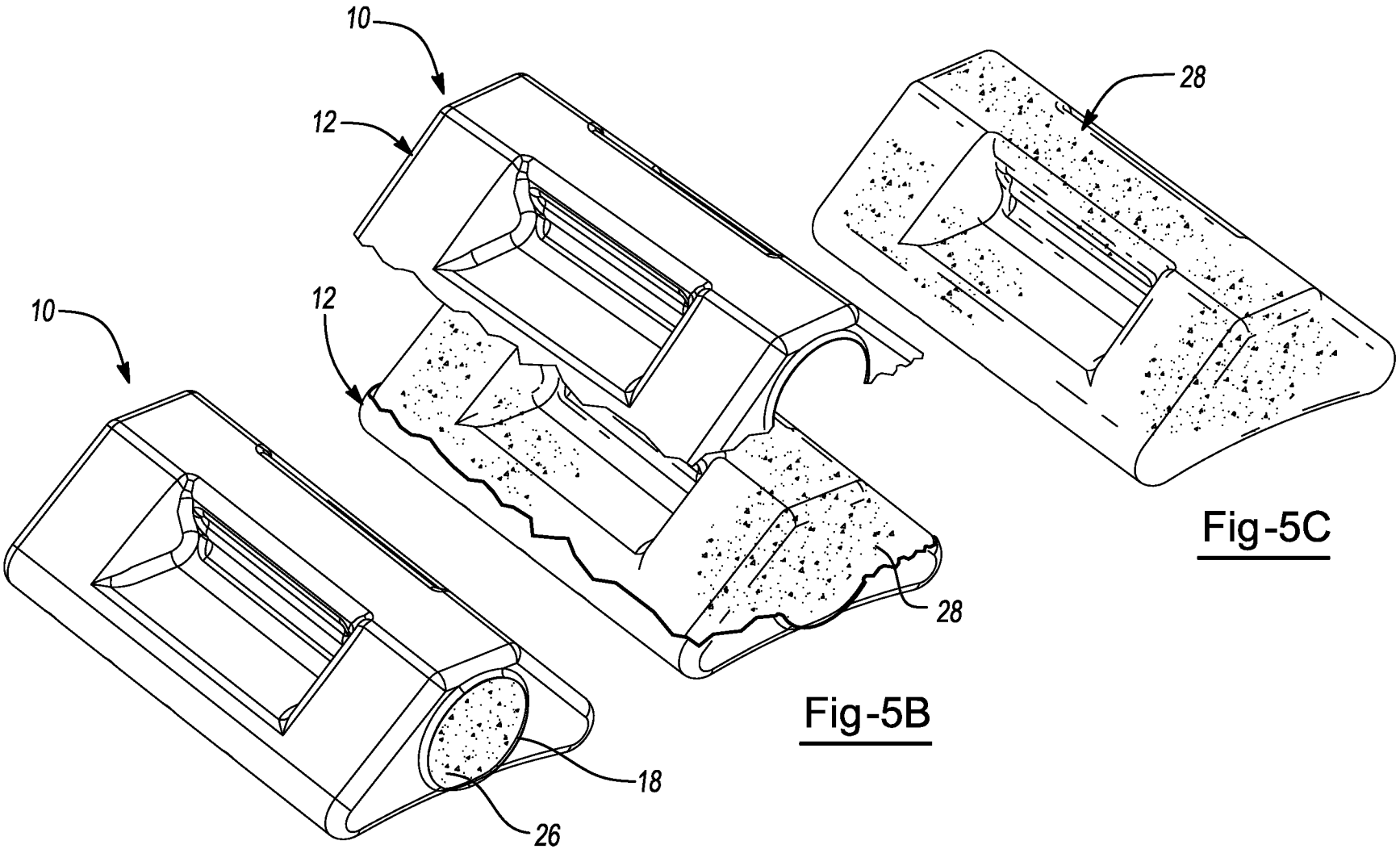
FIG. 5A shows a securing device as shown in FIG. 1 located in a shell as shown in FIG. 2.
FIG. 5B shows the securing device of 6A removed from the shell of 6A.
FIG. 5C shows the resulting securing device as shown in FIG. 1.

FIG. 5A shows an example shell 10 filled with concrete 26. FIG. 5B shows the shell 10, including the receptacle portion 12 being removed from the resulting solid weight 28. FIG. 5C shows the resulting solid weight 28 after the shell has been removed.

Figure 6:
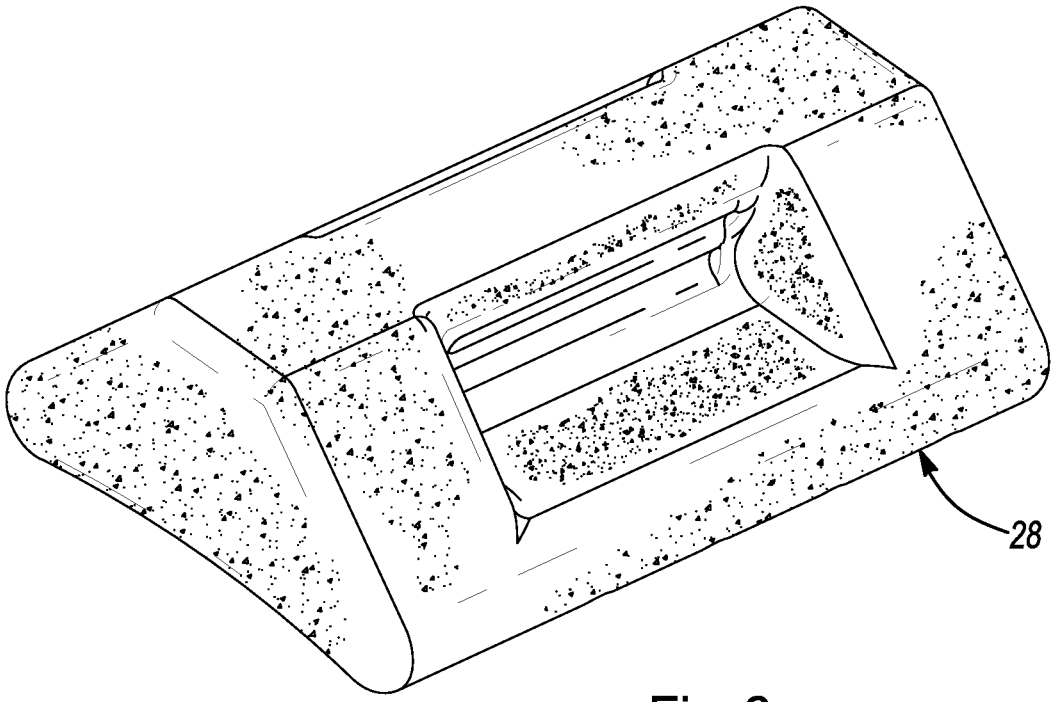
FIG. 6 is a perspective view of a securing device as shown in FIG. 1 being removed from a shell as depicted in FIG. 2.

FIG. 6 shows a resulting solid weight 28 forming the securing device.

Figure 7:
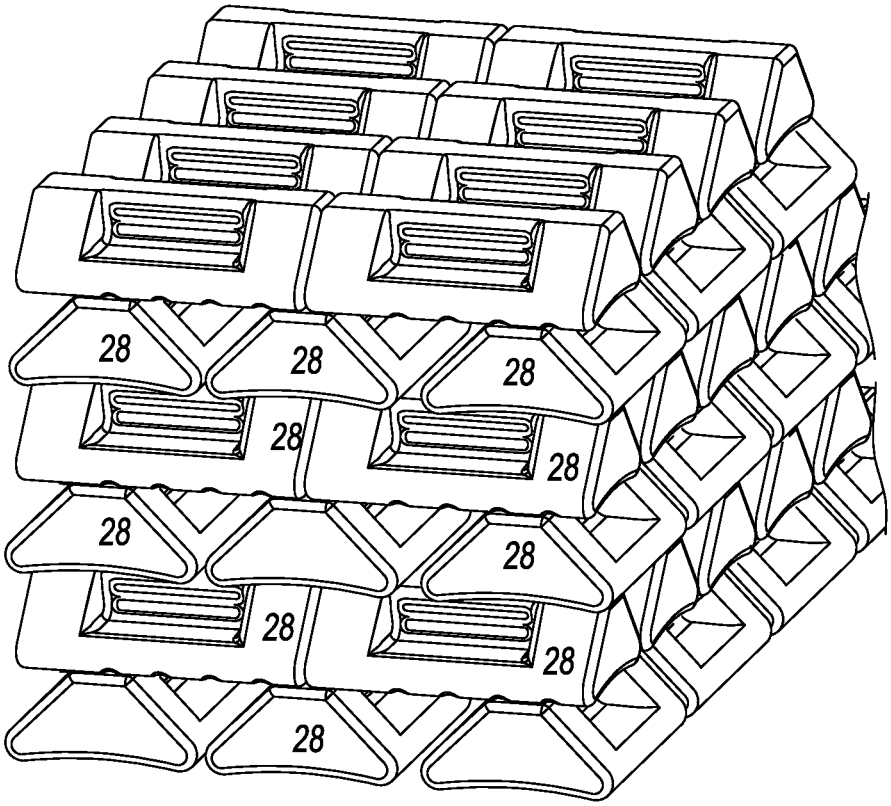
FIG. 7 depicts a plurality of securing devices ready for use.

FIG. 7 shows a plurality of stacked solid weights 28 after having been formed by locating concrete 26 into a plurality of shells (not shown).

Figure 8:
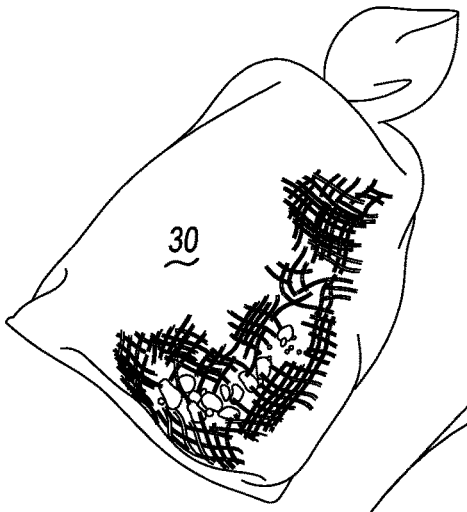
Fig-8 PRIOR ART
FIG. 8 depicts a burlap sack in accordance with the prior art.
Figure 9:
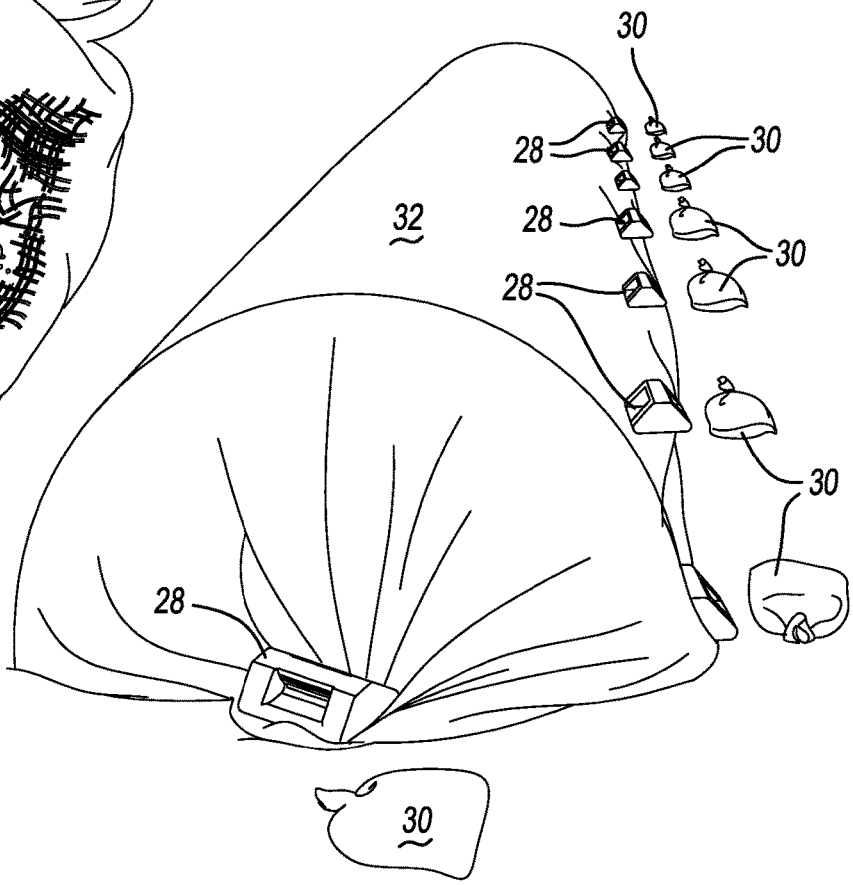
FIG. 9 depicts a plurality of securing device of FIG. 1 in use.

The prior art burlap sacks 30 are shown at FIG. 8, while FIG. 9 shows a plurality of solid weights 28 formed by shells (not shown) replacing the burlap sacks 30 of the prior art and securing a crop cover 32 in place.

Figure 10:
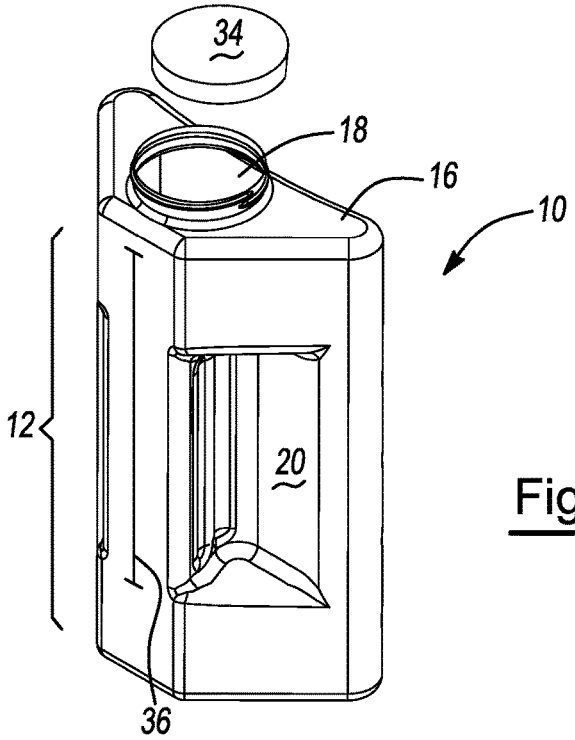
FIG. 10 is a perspective view of an alternative embodiment of a securing device in accordance with the present teachings.

FIG. 10 shows a further example of the shell 10, including the receptacle portion 12 and a cover portion 34. The opening 18 is located in an end wall 16 of the shell. The shell includes an indent 20 that runs parallel to the longitudinal axis 36 of the shell 10.

Unless stated otherwise, dimensions and geometries of the various structures depicted herein are not intended to be restrictive of the invention, and other dimensions or geometries are possible. Plural structural components can be provided by a single integrated structure. Alternatively, a single integrated structure might be divided into separate plural components. In addition, while a feature of the present invention may have been described in the context of only one of the illustrated embodiments, such feature may be combined with one or more other features of other embodiments, for any given application. It will also be appreciated from the above that the fabrication of the unique structures herein and the operation thereof also constitute methods in accordance with the present invention.

The preferred embodiment of the present invention has been disclosed. A person of ordinary skill in the art would realize however, that certain modifications would come within the teachings of this invention. Therefore, the following claims should be studied to determine the true scope and content of the invention.

The explanations and illustrations presented herein are intended to acquaint others skilled in the art with the invention, its principles, and its practical application. Those skilled in the art may adapt and apply the invention in its numerous forms, as may be best suited to the requirements of a particular use. Accordingly, the specific embodiments of the present invention as set forth are not intended as being exhaustive or limiting of the invention. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

What is claimed is:

1. A securing system comprising:

i) a polymeric shell including a receptacle portion and opening adjacent the receptacle portion portion, the receptacle portion being formed as a trapezoidal shape having a base portion, a top portion and exactly two side walls arranged at an angle that is skew to the base portion;

ii) at least one indent formed in each of the exactly two side walls to facilitate handling of the shell;

iii) a flexible sheet covering device;

wherein the opening is adapted to receive a material capable of flowing and optionally curing to form a filled receptacle portion, the filled receptacle portion forming a solid weight for use in securing the flexible covering device by locating a portion of the covering device in between the base portion of the polymeric shell and a ground surface.

2. The securing system of claim 1, wherein the receptacle portion includes at least one end wall.

3. The securing system of claim 2, wherein the at least one opening is located in the at least one end wall.

4. The securing system of claim 1, wherein the material capable of flowing cures and solidifies over time to form the solid weight.

5. The securing system of claim 4, wherein the polymeric shell is cut and removed from the solid weight.

6. The securing system of claim 4, wherein the solid weight is used to secure the flexible covering device while the polymeric shell surrounds the solid weight or once the polymeric shell is removed from the solid weight.

7. The securing system of claim 1, wherein the polymeric shell comprises a material that is substantially UV resistant.

8. The securing system of claim 1, wherein the solid weight is formed by concrete, sand, pebbles, stones, or rocks.

9. The securing system of claim 1, wherein the covering device is a tarp.

10. The securing system of claim 1, wherein a pourable concrete is located into the opening in a flowable state.

11. The securing system of claim 1, wherein the polymeric shell includes one or more indentations.

12. The securing system of claim 1, wherein the polymeric shell comprises a thermoplastic material.

13. The securing system of claim 1, wherein the polymeric shell is formed from one or any combination of polyethylene, high density polyethylene (HDPE), low density polyethylene (LDPE), polyamide, polyethylene terephthalate (PET), biaxially-oriented polyethylene terephthalate (BoPET), polypropylene, polystyrene, polyvinyl chloride, polyurethane, silicone, or synthetic rubber.

14. The securing system of claim 1, wherein the polymeric shell is formed from one or any combination of wood, hemp, or natural rubber.

15. The securing system of claim 1, wherein the polymeric shell is recyclable.

16. The securing system of claim 1, wherein the polymeric shell is re-usable.

17. The securing system of claim 16, wherein the internal surface and/or external surface includes one or more rib structures.

18. The securing system of claim 16, wherein the internal surface is substantially smooth to produce a solid weight having a smooth surface.

19. The securing system of claim 1, wherein the receptacle portion includes an internal surface and an external surface.

* * * * *